US010090614B2

(12) United States Patent
Brantingham et al.

(10) Patent No.: US 10,090,614 B2
(45) Date of Patent: Oct. 2, 2018

(54) ELECTRICAL CONNECTOR HAVING SEALED SNAP-IN LOCKING CAVITY PLUGS

(71) Applicant: DELPHI TECHNOLOGIES, INC., Troy, MI (US)

(72) Inventors: Duane L. Brantingham, Cortland, OH (US); Christopher Adrian Margrave, Ashtabula, OH (US)

(73) Assignee: Delphi Technologies, Inc., Troy, MI (US)

( * ) Notice: Subject to any disclaimer, the term of this patent is extended or adjusted under 35 U.S.C. 154(b) by 11 days.

(21) Appl. No.: 15/296,321

(22) Filed: Oct. 18, 2016

(65) Prior Publication Data

US 2018/0109029 A1 Apr. 19, 2018

(51) Int. Cl.

| | |
|---|---|
| ***H01R 13/52*** | (2006.01) |
| ***H01R 24/28*** | (2011.01) |
| ***H01R 13/05*** | (2006.01) |
| ***H01R 13/428*** | (2006.01) |
| *H01R 107/00* | (2006.01) |

(52) U.S. Cl.

CPC ..... *H01R 13/5208* (2013.01); *H01R 13/05* (2013.01); *H01R 13/428* (2013.01); *H01R 24/28* (2013.01); *H01R 2107/00* (2013.01)

(58) Field of Classification Search

CPC ... H01R 13/5208; H01R 13/05; H01R 13/428
USPC ..... 439/275
See application file for complete search history.

(56) References Cited

U.S. PATENT DOCUMENTS

| | | | | |
|---|---|---|---|---|
| 4,944,688 | A * | 7/1990 | Lundergan | H01R 13/443 439/275 |
| 5,580,264 | A * | 12/1996 | Aoyama | H01R 13/5208 439/275 |
| 6,053,753 | A * | 4/2000 | Kunkle | H01R 13/5221 439/275 |
| 6,247,965 | B1 * | 6/2001 | Cummings | H01R 13/4223 439/148 |
| 6,328,614 | B1 * | 12/2001 | Osawa | H01R 13/4223 439/752 |
| 7,686,647 | B1 * | 3/2010 | Hong | H01R 9/0518 439/595 |
| 8,241,061 | B2 | 8/2012 | Chazottes et al. | |
| 9,112,297 | B2 | 8/2015 | Iwasawa et al. | |
| 2001/0051467 | A1 * | 12/2001 | Kubo | H01R 13/4362 439/752 |
| 2002/0102877 | A1 * | 8/2002 | Nankou | H01R 13/4364 439/595 |

(Continued)

*Primary Examiner* — Abdullah Riyami
*Assistant Examiner* — Nader Alhawamdeh
(74) *Attorney, Agent, or Firm* — Robert J. Myers

(57) ABSTRACT

An electrical connector assembly includes male and female connector bodies formed with a plurality of terminal cavities in which electrical cables are disposed with the terminals secured against removal from the cavities by flexible lances engaging walls within the terminal cavities. A seal on the cables closes and seals the cavities in which they are installed. At least one of the cavities is unoccupied by a cable and is closed by a non-electrically conductive locking cavity plug. The locking cavity plug has a flexible lance that engages a wall within the unoccupied cavity in which it is installed to secure the plug against removal and carries a seal which engages and seals the unoccupied cavity.

9 Claims, 5 Drawing Sheets

(56) References Cited

U.S. PATENT DOCUMENTS

2014/0051276 A1* 2/2014 Itou ..... H01R 13/4223
439/271

* cited by examiner

ELECTRICAL CONNECTOR HAVING SEALED SNAP-IN LOCKING CAVITY PLUGS

TECHNICAL FIELD OF INVENTION

This invention relates generally to electrical connectors having mating male and female connector bodies, and more particularly to the manner of sealing unoccupied terminal cavities of the connectors.

BACKGROUND OF THE INVENTION

Electrical connector assemblies typically include male and female connector bodies, each mounted to the ends of a plurality of electrical cables having mating terminals supported within passages of the respective connector bodies that, when the male and female connectors are joined, provide an electrical connection between the cooperating cables. The passages typically are formed with resilient lock arms that engage cooperating catches on the associated terminals to secure the terminals within the passages.

In some connector applications, it is desirable to seal the connector assembly to protect the terminals from exposure to the external environment. The connector bodies are each formed with a plurality of passages that extend into the connector bodies from the cable end in which the cables and their terminals are received. In a sealed connector application, a seal is provided about the cable that, when installed in the corresponding passage, serves to seal such passage from the outside environment. In some applications, not every passage is occupied by a corresponding cable. There may be, for example, an unequal number of cables occupying the passages of the respective male and female connector bodies. The male connector body may have four cables occupying four of its passages whereas the female cavity may only have two or three of its four passages occupied. In a sealed connector environment, it is necessary to seal the unoccupied cavity or cavities in order to protect the interior of the connector from exposure to the external atmosphere. The present known practice for sealing the unoccupied passages is to install a resiliently compressible elastomeric plug into the unoccupied passage or passages which relies for sealing and retention on a friction fit with the walls of the passages in which they are installed. It is an object of the present invention to provide a more secure means of sealing such unoccupied passages.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of this invention, an electrical connector assembly is provided. The electrical connector assembly includes a connector body having a plurality of terminal cavities extending along an insertion axis into the connector body from opposite cable ends thereof. Each terminal cavity of the plurality of terminal cavities defines a wall substantially perpendicular to the insertion axis. The electrical connector assembly also includes an electrical cable terminated by an electrical terminal formed of a conductive material and disposed within a first terminal cavity of the plurality of terminal cavities. The electrical cable includes a first seal that is formed of a resiliently compressible material and is configured to seal the cable to the first terminal cavity. The electrical terminal defines a resilient first locking lance that engages the wall of the first terminal cavity, thereby inhibiting removal of the terminal from the first terminal cavity. The electrical connector assembly further includes a locking cavity plug formed of a dielectric material that is disposed in a second terminal cavity of the plurality of terminal cavities. The cavity plug has an elongated plug tail and a plug body that defines a resilient second locking lance that engages the wall of the second terminal cavity, thereby inhibiting removal of the cavity plug from the second terminal cavity. The cavity plug includes a second seal formed of a resiliently compressible material that surrounds the plug tail and is configured to seal the plug tail to the second terminal cavity.

The electrical connector assembly may further include a corresponding mating connector body. The connector body and the mating connector body are axially aligned such that a terminal cavity in the mating connector body is aligned with the second terminal cavity and a mating electrical terminal disposed within the terminal cavity in the mating connector body is in a non-interfering relationship with the cavity plug when the connector body and the mating connector body are fully assembled. The plug body may define an opening that is configured to receive the mating electrical terminal.

The plug body may be characterized as having a generally rectangular cross section.

The electrical connector assembly may further include a moveable locking feature that is configured to allow insertion of the electrical terminal within the first terminal cavity and the cavity plug within the second terminal cavity when in an open position and configured to retain of the electrical terminal within the first terminal cavity and the cavity plug within the second terminal cavity when in a closed position. The plug body may define a shoulder that is substantially perpendicular to the insertion axis. This shoulder is in contact with the moveable locking feature when the moveable locking feature is in the closed position.

The second seal may be disposed about a cylindrical portion of the plug tail between longitudinally spaced radial enlargements of the plug tail. The first seal and the second seal of the cable may be identical in construction. The plug tail may extend through the second seal to provide an exposed end portion.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
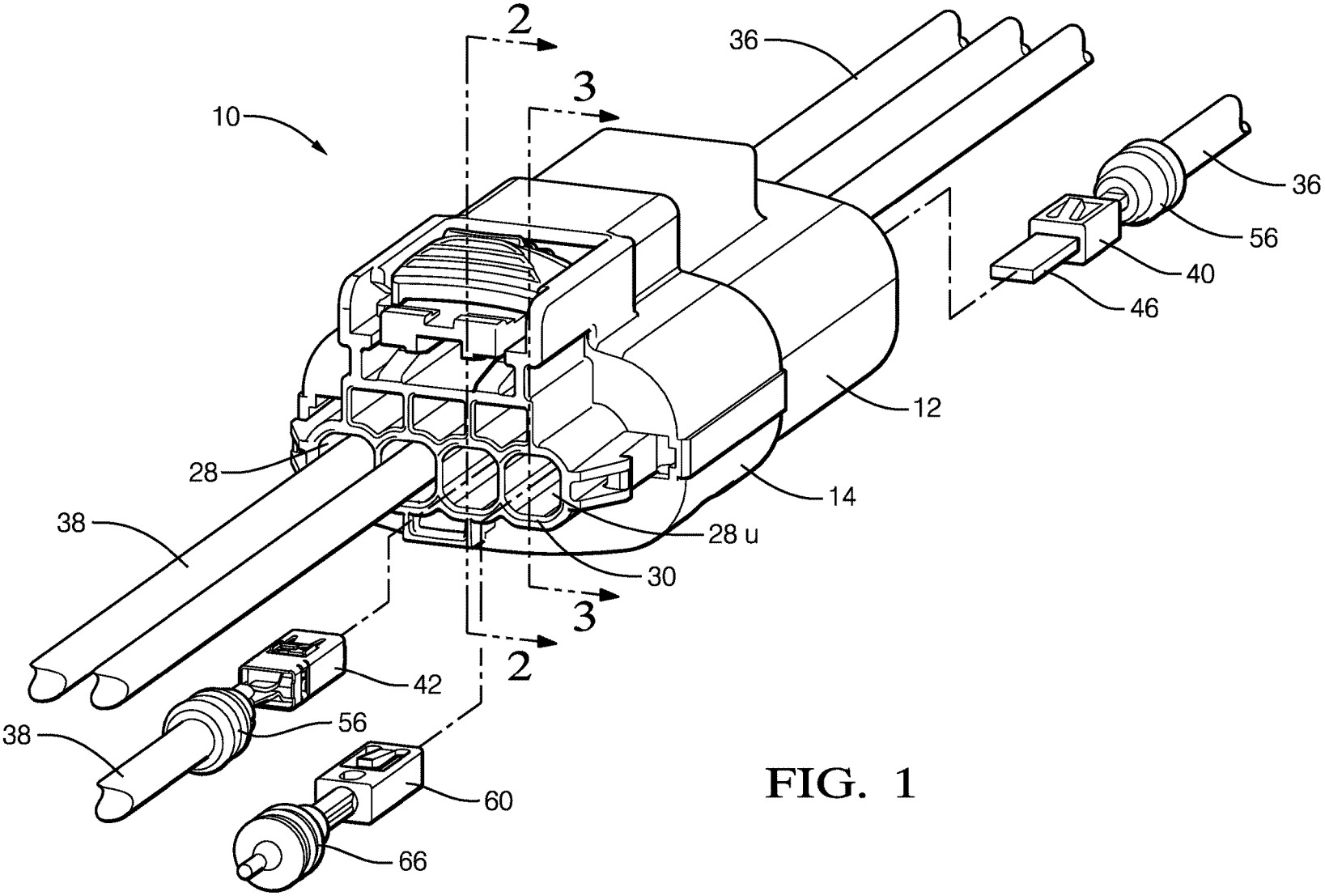
FIG. 1 is an exploded perspective view of an electrical connector assembly in accordance with one embodiment.
Figure 2:
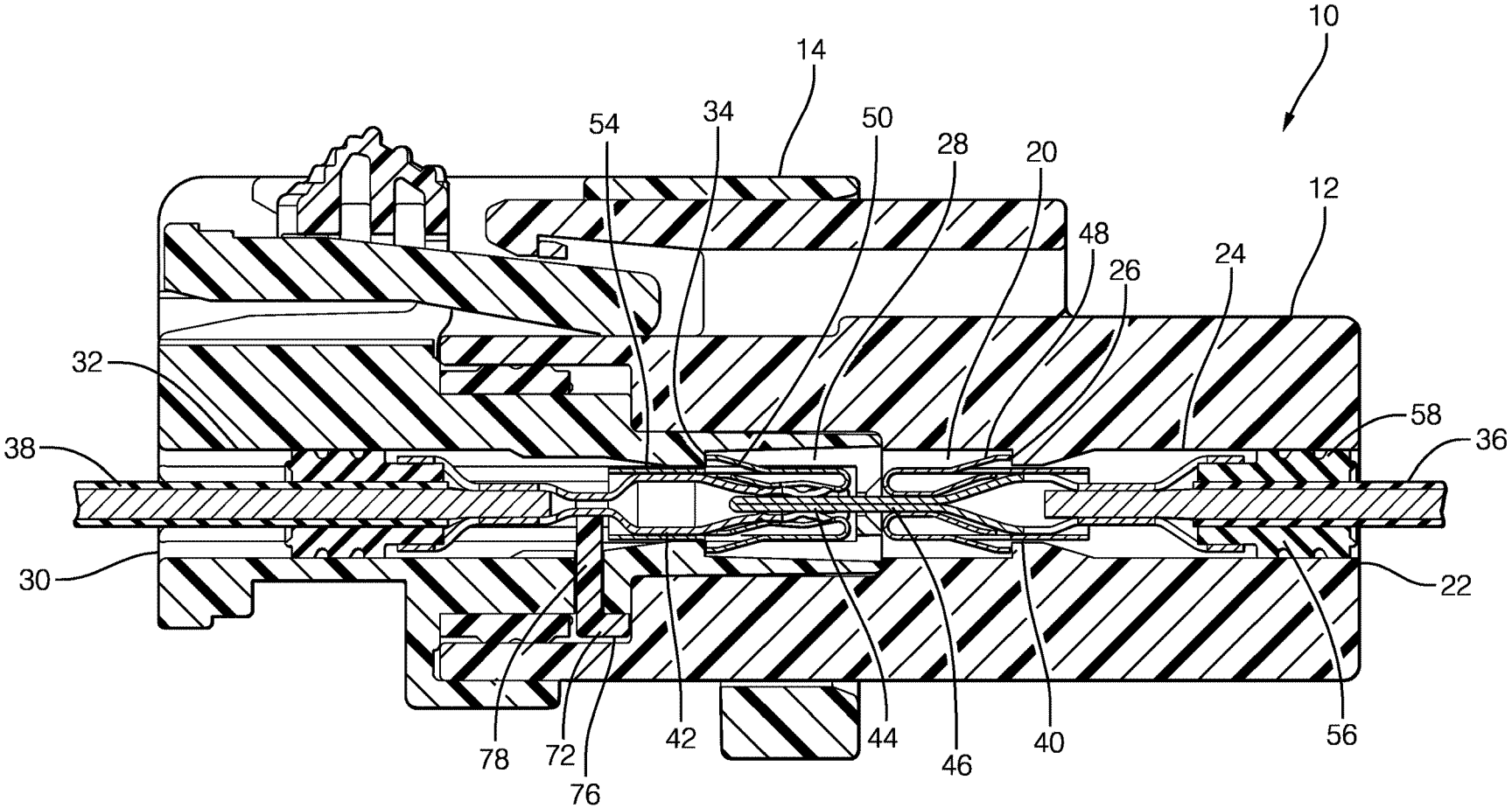
FIG. 2 is a cross section side view of the connector assembly of FIG. 1 in accordance with one embodiment.
Figure 3:
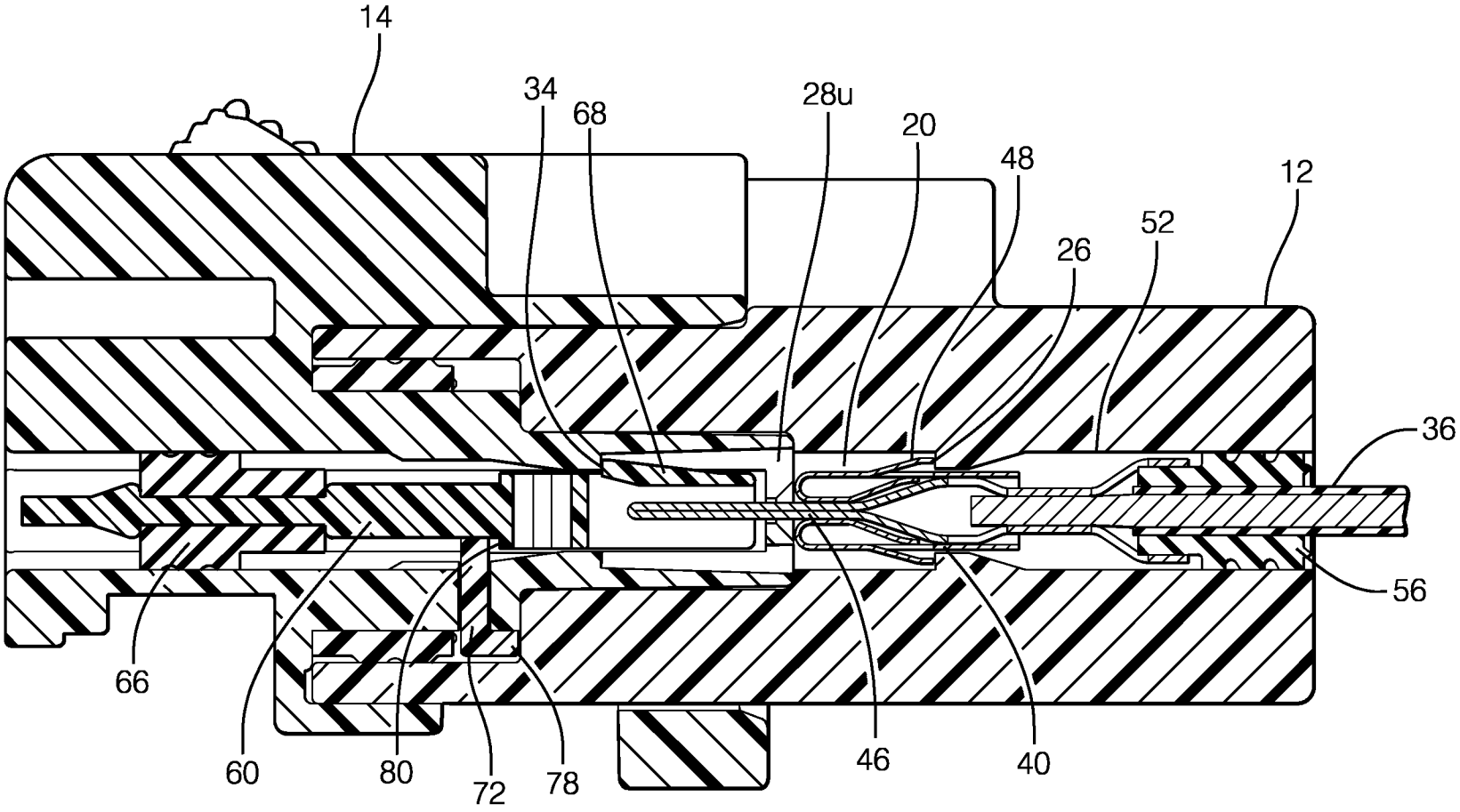
FIG. 3 is an alternate cross section side view of the connector assembly of FIG. 1 in accordance with one embodiment.

A non-limiting example of an electrical connector assembly 10 is generally shown in FIGS. 1-3 of the drawings, and comprises a male connector body 12, hereinafter referred to as the male connector 12 and a mating female connector body 14, hereinafter referred to as the female connector 14. The male and female connectors 12, 14 are molded of a rigid plastic material. The male connector 12 is formed with a plug end and the female connector 14 is formed with a cooperating socket end into which the plug end is inserted for assembling the connectors 12, 14, as shown in the drawings. A lock arm of the female connector 14 engages a locking projection provided on the male connector 12 for securing the connectors 12, 14 in the fully assembled condition.

The male connector 12 is formed with a plurality of terminal cavities 20 extending longitudinally along an insertion axis I into the male connector 12 from an opposite cable end 22 of the male connector. Each of the terminal cavities 20 include a generally cylindrical sealing wall portion 24 adjacent the cable end 22 and a lateral wall 26 that is substantially perpendicular to the insertion axis. The terminal cavities 20 are preferably identical in construction.

The female connector 14 is similarly formed with a plurality of terminal cavities 28, all of identical construction, extending into the female connector 14 from an opposite cable end 30 thereof, and coaxially aligned with the terminal cavities 20 of the male connector 12. The female terminal cavities 28 likewise include cylindrical sealing walls 32 adjacent the cable end 30 and a lateral wall 34 that is substantially perpendicular to the insertion axis.

A plurality of electrical cables 36 occupy at least some of the terminal cavities 20 of the male connector 12, and another plurality of cables 38 occupy at least some of the terminal cavities 28 of the female connector 14. The cables 36, 38 extend into their respective cavities 20, 28 through the open cable end 22, 30 thereof, and have terminals 40, 42 disposed within the connectors 12, 14, at least some of which mate when the connectors 12, 14 are joined to establish an electrical connection between the mating cables 36, 38. The terminals 40 of the male cables 36 have elongated blades 46 that project beyond the cavities 20 of the male connector 12 into the cavities 28 of the female connector 14 in overlapping relation to the terminals 42 of the female cables 38. The terminals 42 of the female cables 38 are formed with receptacle portions 44 which wrap around and frictionally engage the blades 46 to establish metal-to-metal electrical contact therebetween. It will be seen that the terminals 42 of the female cables 38 are contained within the terminal cavities 28 of the female connector 14 and as such do not project into the terminal cavities 20 of the male connector 12.

The terminals 40, 42 include integrally formed resilient cantilevered locking lances 48, 50 respectively, that, when the terminals 40, 42 are fully inserted into the terminal cavities 20, 28, engage the lateral walls 26, 34 to secure the cables 36, 38 against removal from the terminal cavities 20, 28. As the terminals 40, 42 are extended into the terminal cavities 20, 28, a leading end of the locking lances 48, 50 engage longitudinal walls 52, 54 of the terminal cavities 20, 28, deflecting the locking lances 48, 50 laterally inwardly, until such time as the locking lances clear the longitudinal walls 52, 54 and spring outwardly. A trailing free end of the locking lances 48, 50 then engage the lateral walls 26, 34 to secure the terminals 40, 42 of the cables 36, 38 from withdrawal from the terminal cavities 20, 28.

Each of the cables 36, 38 is provided with a seal 56 in the preferred form of an annular sleeve having at least one and preferably a plurality of annular ribs or lips 58 engaging the cylindrical walls 24, 32 of the terminal cavities 20, 28 to seal the cavities 20, 28 from exposure to the external atmosphere in order to prevent moisture, dirt, and other contaminants from damaging the connector assembly 10.

The connector assembly thus far described is conventional, and is representative of the typical sealed electrical connector wherein the terminals 40, 42 of the cables 36, 38 lock within the cavities and seal the cavities from the outside atmosphere. In many applications, less than all of the terminal cavities 20, 28 are occupied by such cables 36, 38. In sealed connector applications, the unoccupied cavity or cavities must nonetheless be sealed to maintain a sealed environment within the connector assembly 10. In the illustrated embodiment, the female connector 14 has one of its cavities unoccupied by a cable, designated at **28*u* in FIGS. 1 and 2. The cavity of the other connector aligned with the unoccupied terminal cavity 28*u* is occupied by a male terminal, which is not electrically active, but nonetheless supported by the connector assembly 10**.

Figure 4:
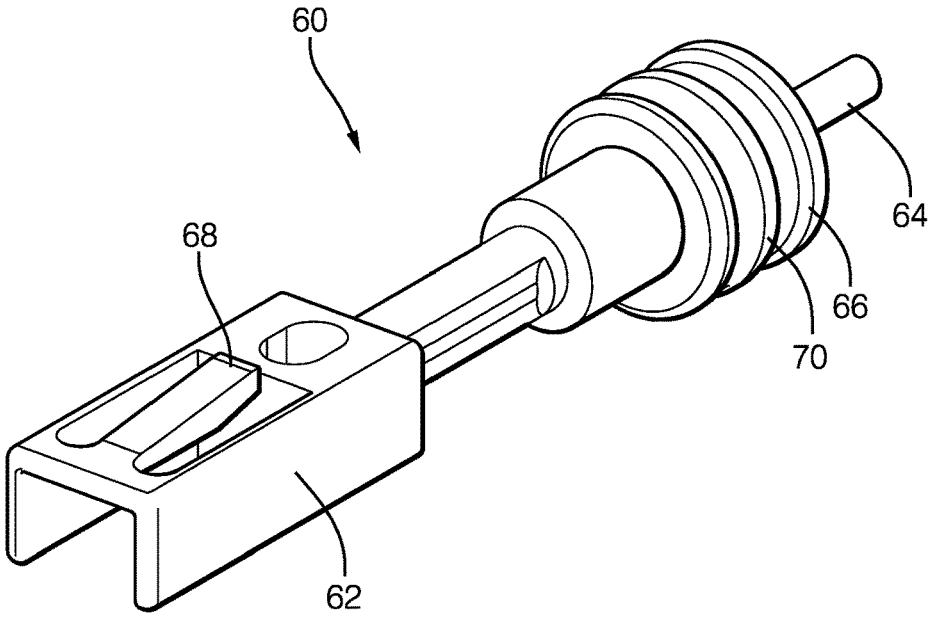
FIG. 4 is a perspective view of a cavity plug of the connector assembly of FIG. 1 in accordance with one embodiment.
Figure 5:
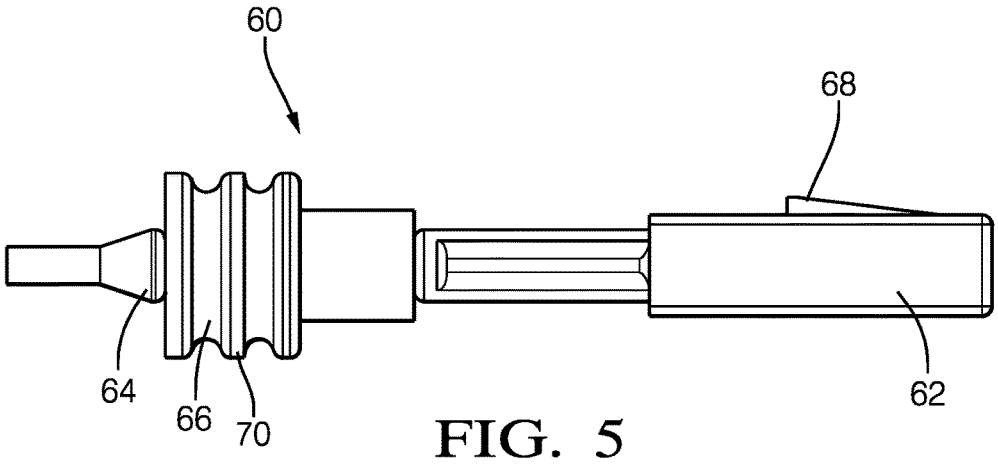
FIG. 5 is a side view of the cavity plug of FIG. 4 in accordance with one embodiment.
Figure 6:
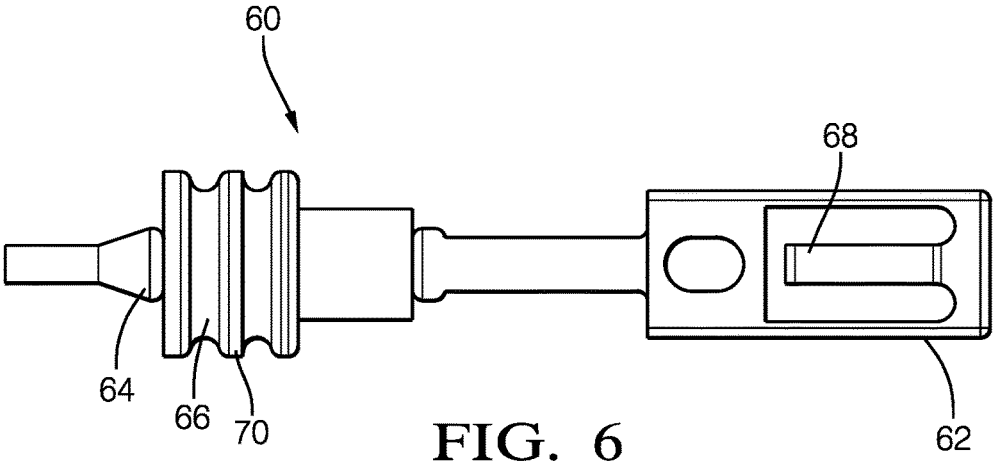
FIG. 6 is a top view of the cavity plug of FIG. 4 in accordance with one embodiment.

A locking cavity plug 60 is provided and installed in the unoccupied terminal cavity **28*u* of the female connectors 14. As shown in FIGS. 4-6, the locking plug 60 has a plug body 62 adjacent its leading end with a plug tail 64 extending from the plug body 62 toward their tailing ends and a seal 66 surrounding the plug tail 64. As shown in FIGS. 1 and 3, the plug body 62 has a generally rectangular cross section and defines an integrally formed resilient cantilevered locking lance 68 that, when the cavity plug 60 is fully inserted into the terminal cavity 28*u*, engages the lateral wall 26 to secure the cavity plugs against removal from the terminal cavity 28*u*. As the cavity plug 60 is inserted into the terminal cavity 28*u*, the leading end of the locking lance 68 engages the longitudinal wall 32 of the terminal cavity 28*u*, deflecting the locking lance 68 laterally inwardly, until such time as the locking lance 68 clear the longitudinal wall 32 and springs outwardly. A free end of the locking lance 68 then engage the lateral wall 26 to secure the cavity plugs from withdrawal from the terminal cavity 28*u*. The seal 66 preferably comprises an annular sleeve disposed about the plug tail 64 and the plug 60 sealingly engages the cylindrical wall 24 of the unoccupied cavity 28*u*. The seal 66 is preferably of identical construction to the seals 56 of the cables 36, 38, and thus includes at least one, and preferably a plurality of, radial outer ribs or lips 70 that engage and seal the wall 24 and thus close the unoccupied cavity 28*u*. The seal 66 is fabricated of a resiliently compressible plastics material different than that used for the rigid plastic plug body 62. The seal 66 is preferably annular and thus permits installation of the locking plug 60 without regard to rotational orientation to achieve both locking and sealing within the unoccupied cavity 28***u*.

Figure 7:
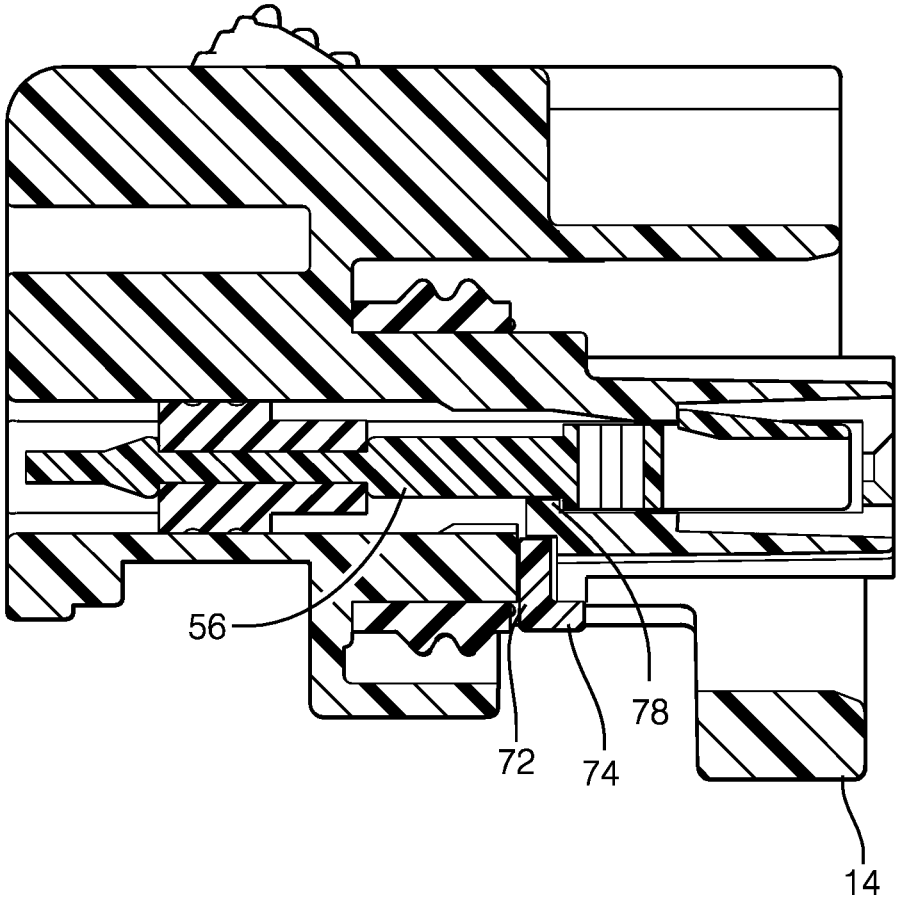
FIG. 7 is a cross section side view a connector body of the connector assembly of FIG. 1 with a terminal position assurance device in an open position in accordance with one embodiment.

The connector assembly further includes a moveable locking feature 72, typically referred to as a terminal position assurance (TPA) device 72. When the TPA device 72 is in an open position 74 (see FIG. 7), it allows the terminals and cavity plugs to be fully inserted within the terminal cavities. When moved to a closed position 76 (see FIG. 3), a portion of the TPA device is moved into the terminal cavity and contacts a shoulder 78 on the head of the terminal or a shoulder 78 on the plug body, thereby further inhibiting removal of the terminal or plug cavity from the terminal cavity.

It can be seen in FIG. 3 that the head of the terminal 40 is accommodated within an opening in the plug body so that the cavity plug does not interfere with a companion terminal 42 of the axially adjacent occupied cavity 28 of the mating connector 14.

Thus, an electrical connector assembly 10 is provided. The assembly 10 provides a means of sealing the unoccupied cavities of male and female connector bodies 12, 14 by means of a locking cavity plug 60 formed with a locking lance 68 that engage a lateral wall 26 within the cavity 28*u* to lock the plug 60 against removal from the cavity 28*u* ensuring that the connector assembly 10 remains weathertight during the full service life of the electrical connector assembly. The cavity plug 60 includes shoulders that are compatible with a TPA device to further ensure against inadvertent removal of the cavity plug 60 from the terminal cavity 28*u*.

While the illustrated example shows a cavity plug inserted within an unoccupied terminal cavity 28*u* in a female connector body 14, other embodiments may be envisioned in which a cavity plug is similarly configured to be inserted within an unoccupied terminal cavity of a male connector body 12.

While this invention has been described in terms of the preferred embodiments thereof, it is not intended to be so limited, but rather only to the extent set forth in the claims that follow. Moreover, the use of the terms first, second, upper, lower, etc. does not denote any order of importance or orientation, but rather the terms first, second, upper, lower, etc. are used to distinguish one element from another. Furthermore, the use of the terms a, an, etc. do not denote a limitation of quantity, but rather denote the presence of at least one of the referenced items.

We claim:

1. An electrical connector assembly, comprising:

a connector body having a plurality of terminal cavities extending along an insertion axis into the connector body from opposite cable ends thereof, wherein each terminal cavity of the plurality of terminal cavities defines a longitudinal wall substantially parallel to the insertion axis and a lateral wall substantially perpendicular to the insertion axis;

an electrical cable terminated by an electrical terminal formed of a conductive material and disposed within a first terminal cavity of the plurality of terminal cavities, wherein the electrical cable includes a first seal formed of a resiliently compressible material configured to seal the cable to the first terminal cavity and wherein the electrical terminal defines a resilient cantilevered first locking lance extending from the electrical terminal that is configured to deflect inwardly as the first locking lance engages the longitudinal wall of the first terminal cavity and deflect outwardly to engage the lateral wall of the first cavity when first locking lance clears the longitudinal wall of the first terminal cavity, thereby inhibiting removal of the terminal from the first terminal cavity; and a cavity plug formed of a dielectric plastic material disposed in a second terminal cavity of the plurality of terminal cavities having a plug body and an elongated plug tail integrally formed with the plug body, said cavity plug further defining a resilient cantilevered second locking lance integrally formed with the plug body of the dielectric plastic material and extending from the plug body, said second locking lance configured to deflect inwardly as the second locking lance engages the longitudinal wall of the second terminal cavity and deflect outwardly to engage the lateral wall of the second cavity when second locking lance clears the longitudinal wall of the second terminal cavity, thereby inhibiting removal of the cavity plug from the second terminal cavity, wherein the cavity plug includes a second seal formed of a resiliently compressible material that surrounds the plug tail and is configured to seal the plug tail to the second terminal cavity.

2. The electrical connector assembly in accordance with claim 1, further comprising a corresponding mating connector body, wherein the connector body and the mating connector body are axially aligned such that a terminal cavity in the mating connector body is aligned with the second terminal cavity and a mating electrical terminal disposed within the terminal cavity in the mating connector body is in a non-interfering relationship with the cavity plug when the connector body and the mating connector body are fully assembled.

3. The electrical connector assembly in accordance with claim 2, wherein the plug body defines an opening configured to receive the mating electrical terminal.

4. The electrical connector assembly in accordance with claim 1, wherein the plug body is characterized as having a generally rectangular cross section.

5. The electrical connector assembly in accordance with claim 4, further comprising a moveable locking feature configured to allow insertion of the electrical terminal within the first terminal cavity and the cavity plug within the second terminal cavity when in an open position and configured to retain of the electrical terminal within the first terminal cavity and the cavity plug within the second terminal cavity when in a closed position.

6. The electrical connector assembly in accordance with claim 5, wherein the plug body defines a shoulder substantially perpendicular to the insertion axis that is in contact with the moveable locking feature when the moveable locking feature is in the closed position.

7. The electrical connector assembly in accordance with claim 1, wherein the second seal is disposed about a cylindrical portion of the plug tail between longitudinally spaced radial enlargements of the plug tail.

8. The electrical connector assembly in accordance with claim 1, wherein the first seal and the second seal of the cable are identical in construction.

9. The electrical connector assembly in accordance with claim 1, wherein the plug tail extends through the second seal to provide an exposed end portion.

* * * * *